US007378987B2

(12) United States Patent
Jacobs

(10) Patent No.: US 7,378,987 B2
(45) Date of Patent: May 27, 2008

(54) TRAFFIC CONTROL MALFUNCTION MANAGEMENT UNIT WITH PER CHANNEL RED ENABLE

(75) Inventor: Allen Jacobs, Reno, NV (US)

(73) Assignee: Reno A & E, Reno, NV (US)

( * ) Notice: Subject to any disclaimer, the term of this patent is extended or adjusted under 35 U.S.C. 154(b) by 793 days.

(21) Appl. No.: 10/718,819

(22) Filed: Nov. 21, 2003

(65) Prior Publication Data

US 2005/0138488 A1 Jun. 23, 2005

(51) Int. Cl.
*G08G 1/095* (2006.01)

(52) U.S. Cl. ..... 340/931; 340/907; 340/642

(58) Field of Classification Search ..... 340/931, 340/907, 908.1, 915, 916, 918, 923, 515, 340/642, 912, 914; 73/1.01, 865.6, 865.9
See application file for complete search history.

(56) References Cited

U.S. PATENT DOCUMENTS 4,586,041 A * 4/1986 Carlson ..... 340/931
4,734,862 A * 3/1988 Marcus et al. ..... 701/117
5,327,123 A * 7/1994 Heimann et al. ..... 340/916
5,734,116 A * 3/1998 Schaeffer ..... 73/865.6

OTHER PUBLICATIONS

Letter dated Jul. 30, 2005 signed by William L. Russell, President and CEO of Eberle Design, Inc.
Memo entitled "To Whom it May Concern" 1993.
Excerpt of the California Dept. of Transportation TEES Specification(4 pages) dated Aug. 16, 2002.
210E Operations Manual with Addendum Revision Feb. 1998.
City of Los Angeles 2010 Conflict Monitor Specification Oct. 2000.
Operations Manual 2010 Series Nov. 1998 Revision with Addendum.

* cited by examiner

*Primary Examiner*—Van T. Trieu

(57) ABSTRACT

A method and apparatus for monitoring for Red Fail faults in a traffic signal control system. Traffic control signals generated by a traffic control unit are grouped into channels. Certain channels are specified for Red Fail testing in which all lights in a given channel are inactive at the same time. Channels which are not specified are not subject to Red Fail testing, but other conflict testing can still be performed on these unselected channels.

8 Claims, 2 Drawing Sheets

TRAFFIC CONTROL MALFUNCTION MANAGEMENT UNIT WITH PER CHANNEL RED ENABLE

BACKGROUND OF THE INVENTION

This invention relates to traffic control equipment used to monitor the states of traffic signal head control signals for proper operation. More particularly, this invention relates to a malfunction management unit which permits selective enabling and disabling of the Red Fail test normally use to monitor for the absence of any activated traffic signal head control signals in a given channel.

Traffic signal heads are commonly used to regulate the flow of vehicular and pedestrian traffic. A typical traffic signal head is provided with red, yellow, and green A.C. operated light sources, and the operation of these light sources is under the control of a unit termed a controller assembly. For safety reasons, the traffic control industry has long used equipment to monitor the states of the electrical power signals generated by the controller assembly and used to operate the traffic signal head light sources for proper operation. Under the TS-1 standard, this equipment is called a conflict management unit (CMU); under the later TS-2 standard, this equipment is called a malfunction management unit (MMU).

A controller assembly and an MMU are typically configured together in one of two configurations—Type 16 and Type 12. In either configuration, the traffic control signals from the controller assembly to the signal heads in a controlled intersection are typically grouped into channels, with the signals for a given phase assigned to the same channel. In a Type 16 configuration, there are a total of sixteen channels, each consisting of three 120 volt A.C. outputs: Green/Walk, Yellow, and Red/Don't Walk. In a Type 12 configuration there are a total of twelve channels, each consisting of four 120 volt A.C. outputs: Green, Yellow, Walk, and Red.

One of the tests customarily applied to the control signals in each channel is termed the Red Fail test. This test checks whether at least one of the traffic light control signals in a channel is active. If not, all the lights controlling that phase of the intersection are dark and the phase is uncontrolled. When this condition occurs, the MMU generates a fault signal and the traffic signals are forced into a flashing mode of operation, overriding the normal mode of operation.

Although the Red Fail test is widely used, this standard test is inaccurate and not suitable for some traffic control arrangements. More specifically, in some applications it may be required that the lights in one channel all be dark during one operational phase. For example, in an application having an advance warning sign with lights of two different colors positioned ahead of a controlled intersection, it may be desirable to have both types of light inactive at the same time during some operational phase. If the Red Fail test is active, a Red Fail fault would be registered when both types of light are inactive. Consequently, unless some provision is made to enable selective inactivation of the Red Fail test for a specific channel, the lights in such an application cannot be monitored for other conflicts—such as a Dual Indication (both types of light active at the same time).

SUMMARY OF THE INVENTION

The invention comprises a malfunction management unit for traffic signal control equipment with per channel red enable monitoring which allows the selection of channels for which the Red Fail test can be enabled or disabled to accommodate those applications in which Red Fail monitoring is not desirable for one or more specific channels. According to the invention, Red Fail monitoring will only be conducted for those channels for which this test function is specified From an apparatus standpoint, the invention comprises a malfunction management unit for a traffic control system for monitoring traffic control signals for a Red Fail fault in which no signal is active in a given channel, the malfunction management unit having input terminals for receiving control signals grouped in channels and used to operate the traffic control lights; monitoring means for detecting a Red Fail fault from the signals in the channels; and channel selection means for enabling a Red Fail test on a channel specific basis.

The malfunction management unit preferably includes a manually settable switch for enabling and disabling the channel selection means. The malfunction management unit further preferably includes an output for controlling the operation of an output relay used to transfer the operation of the traffic control lights to a flashing mode of operation when a Red Fail is detected.

From a process standpoint, the invention comprises a method of monitoring for Red Fail faults in a traffic control system for coordinated operation of a plurality of traffic control lights; the method comprising the steps of providing a plurality of input terminals for receiving control signals grouped in channels and used to operate the traffic control lights; specifying those channels for which a Red Fail test is to be performed; and monitoring the control signals in the specified channels for a Red Fail fault. The method further includes the step of controlling the operation of an output relay used to transfer the operation of the traffic control lights to a flashing mode of operation when a Red Fail fault is detected. The method preferably includes the step of providing a manually settable switch for enabling and disabling the specifying means. The method may further include the step of providing a display for indicating whether a Red Fail fault has occurred.

The invention provides enhanced flexibility for MMUs by providing for Red Fail tests on only selected channels to account for alternate intersection configurations for which the Red Fail test is not readily suitable.

For a fuller understanding of the nature and advantages of the invention, reference should be had to the ensuing detailed description taken in conjunction with the accompanying drawings.

DETAILED DESCRIPTION OF THE PREFERRED EMBODIMENTS

Figure 1:
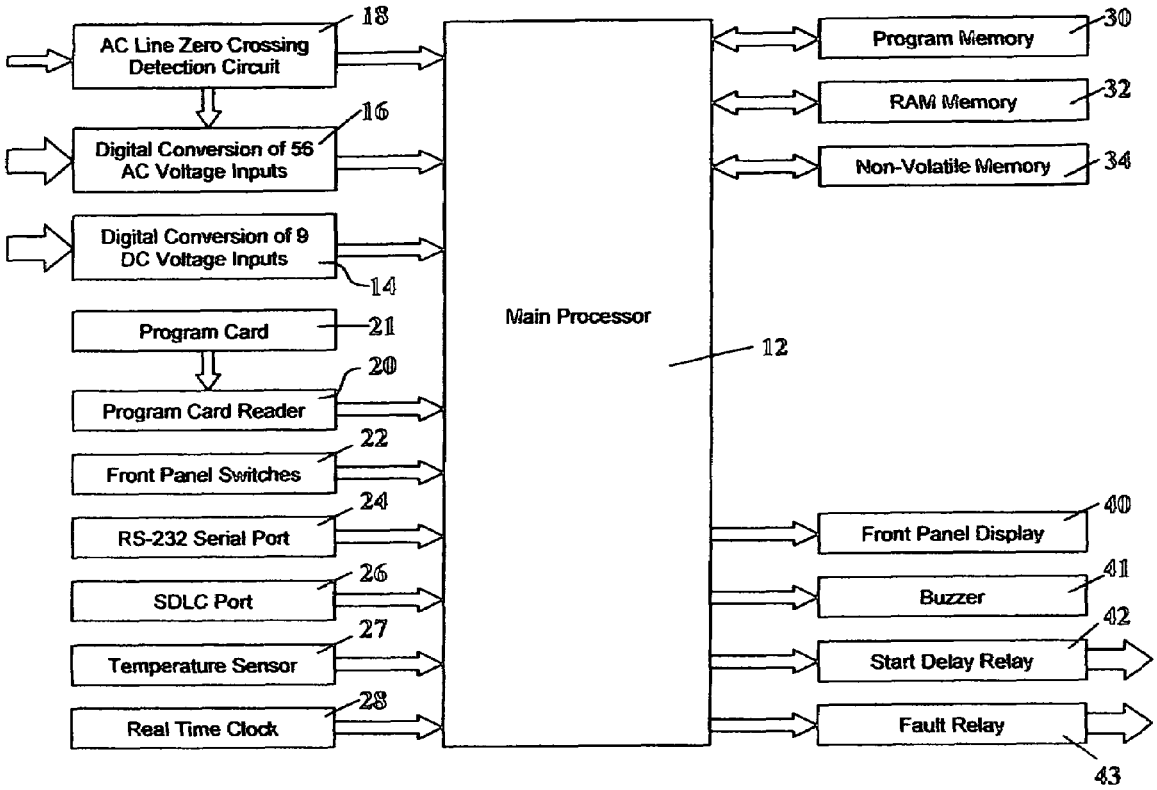
FIG. 1 is a block diagram of a malfunction management unit incorporating the invention.

Turning now to the drawings, FIG. 1 is a block diagram of a malfunction management unit incorporating the invention. As seen in this FIG., the malfunction management unit (MMU) includes a main processor 12, preferably an AMD Am186CH-40 16-bit microprocessor, and nine microcontrollers. One of these microcontrollers designated with reference numeral 14 is used for digital conversion of nine D.C. voltage inputs from the several D.C. voltage sources used in the associated traffic control system. This microcontroller is preferably an Atmel AT90LS8535 device. Seven of the microcontrollers collectively designated with reference numeral 16 are used for digital conversion of fifty six A.C. voltage inputs from the traffic control unit, with each microcontroller handling eight A.C. voltag inputs. An A.C. line zero crossing unit 18 provides zero crossing information to main processor 12. A program card reader 20 provides programming information relating to configuration parameters read from a programming card 21 described in detail below. A plurality of settable switches 22 mounted on the front panel of the MMU housing enable operator selection of several different functions for individual channels as described more fully below. An RS-232 serial port 24 enables communications between the MMU and a laptop computer for local communications and a modem for remote communications. An SDLC port 26 enables communications with the traffic controller. A temperature sensor 27 is provided to monitor the temperature inside the cabinet housing the MMU and the traffic controller. A real time clock 28 provides a real time reference for the main processor.

The main processor 12 is coupled to a program memory unit 30, RAM memory unit 32 and non-volatile memory unit 34. The purpose of each of these memory units is described more fully below. Main processor is also coupled to a front panel display 40 shown in FIG. 2; an audible buzzer 41; a start delay relay 42; and a fault relay 43. The structure and function of units 40-43 are described more fully below.

Figure 2:
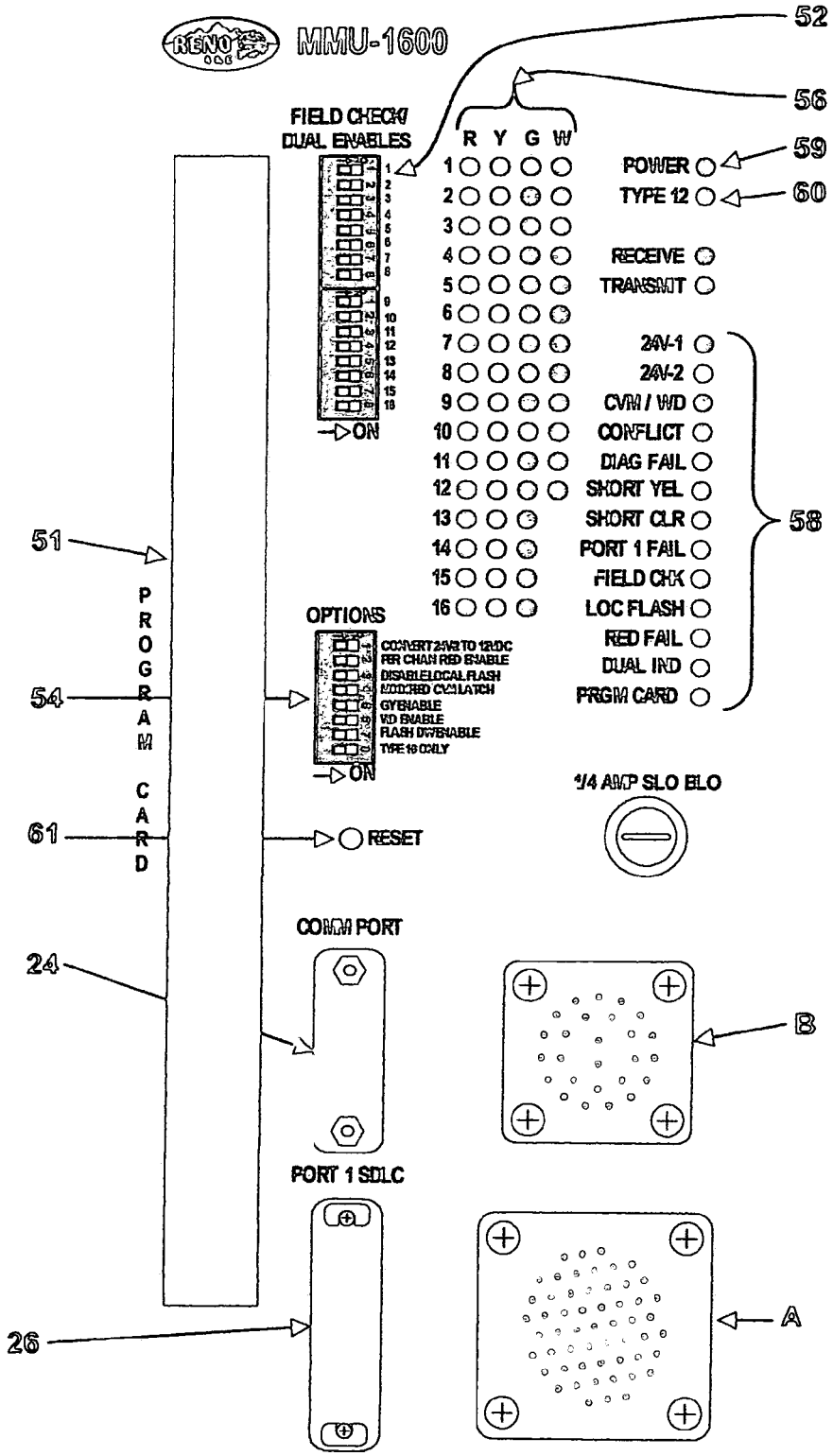
FIG. 2 is a view of the front panel of the malfunction management unit of FIG. 1 showing the settable switches and displays incorporated into the preferred embodiment of the invention.

FIG. 2 illustrates the front panel of the MMU. As seen in this FIG. , a program card slot 51 enables a user to insert and remove programming card 21. Sixteen two position switches 52 enable operator selection of the Field Check/Dual Enable functions described more fully below on a per channel basis. Eight two position switches 54 enable operator selection of different options. These options are termed "Convert 24 V-2 to 12VDC"; "Per Channel Red Enable"; "Disable Local Flash"; "Modified CVM Latch"; "GY Monitoring Enable"; "Watchdog Enable"; "Flash DW Enable"; and "Type 16 Only" and are individually described in detail below.

A first display group 56 comprising sixty LED indicators provides field status indications for the various Red, Yellow, Green and Walk field inputs. A second display group 58 provides fault information relating to the status of specific fault conditions and whether the particular fault test is enabled or disabled. A pair of connectors (A and B) provide electrical connections for the various input signals described above with reference to FIG. 1.

A Power LED 59 indicates whether power is being applied to the MMU; while a Type 12 LED 60 indicates whether the user has selected Type 12, Type 16, or Type 16 only modes of operation, described below. Lastly, a Reset button switch 61 enables a technician to attempt manual reset of faults recorded by the MMU. Pushing this button also turns on all display LEDs for a period of time sufficient to visually determine if all LEDs are operational.

PER CHANNEL RED FAIL MONITORING

The present invention is directed to the Per Channel Red Fail Monitoring incorporated into the MMU described herein. When this function is enabled, a Red Fail test is applied to signals in only selected channels, and not to any other channel. Thus, a Red Fail fault will only occur if all lights in a channel selected for Red Fail monitoring are inactive at the same time. However, other conflict testing for channels not selected for Red Fail monitoring, such as dual indication testing, will be unaffected by the enabling of the Per Channel Red Fail monitoring function. Thus, for example, in the advance warning sign application noted above, dual indication testing will still be performed to check whether both types of light are active at the same time; but any inactivity of both types of light will be ignored for conflict testing purposes.

Per channel Red Fail monitoring is configured for each channel, individually, through software implementation. Per Channel Red Fail monitoring is enabled for the MMU by operating the PER CHAN RED ENABLE option switch in switch group 54 to the ON position. When enabled, the Per Channel Red Fail monitoring function examines the signal lines for only selected channels when conducting a Red Fail test. In the preferred embodiment, the requisite inactivity must persist for at least 1,000 milliseconds before a Red Fail fault is generated.

As will now be apparent to those skilled in the art, the Per Channel Red Fail monitoring feature adds a flexible feature to an MMU which enables selective use of the Red Fail test for some but not all of the channels in intersection configurations.

A complete description of the MMU comprising the preferred embodiment of the invention is attached hereto as Appendix A and forms an integral part of this disclosure.

Although the above provides a full and complete disclosure of the preferred embodiments of the invention, various modifications, alternate constructions and equivalents will occur to those skilled in the art. For example, although specific microprocessors and microcontrollers have been identified for the preferred embodiment, other such devices may be employed in the implementation of the equivalents will occur to those skilled in the art. For example, although specific microprocessors and microcontrollers have been identified for the preferred embodiment, other such devices may be employed in the implementation of the invention. Therefore, the above should not be construed as limiting the invention, which is defined by the appended claims.

What is claimed is:

1. A malfunction management unit for a traffic control system for monitoring traffic control signals for a Red Fail fault in which no signal is active in a given channel, the malfunction management unit having input terminals for receiving control signals grouped in channels and used to operate the traffic control lights; monitoring means for detecting a Red Fail fault from the signals in the channels; and channel selection means for enabling a Red Fail test on a channel specific basis.

2. The invention of claim 1 wherein said malfunction management unit includes a manually settable switch for enabling and disabling said channel selection means.

3. The invention of claim 1 wherein said malfunction management unit includes a display for indicating whether a Red Fail fault has occurred in a selected channel.

4. The invention of claim 1 wherein said malfunction management unit includes an output for controlling the operation of an output relay used to transfer the operation of the traffic control lights to a flashing mode of operation when a Red Fail is detected in a selected channel.

5. A method of monitoring for Red Fail faults in a traffic control system for coordinated operation of a plurality of traffic control lights; the method comprising the steps of:

(a) providing a plurality of input terminals for receiving control signals grouped in channels and used to operate the traffic control lights;

(b) specifying those channels for which a Red Fail test is to be performed; and (c) monitoring the control signals in the specified channels for a Red Fail fault.

6. The method of claim 5 further including the step of controlling the operation of an output relay used to transfer the operation of the traffic control lights to a flashing mode of operation when a Red Fail fault is detected in a specified channel.

7. The method of claim 5 further including the step of providing a manually settable switch for enabling and disabling the specifying step (b).

8. The method of claim 5 further including the step of providing a display for indicating whether a Red Fail fault has occurred in a specified channel.

* * * * *